US010661187B2

(12) United States Patent
Au et al.

(10) Patent No.: US 10,661,187 B2
(45) Date of Patent: May 26, 2020

(54) TOY VEHICLE TRACK SET

(71) Applicant: Mattel, Inc., El Segundo, CA (US)

(72) Inventors: Tsz Ho Alex Au, Kwai Chung (HK); Marcel Santos, Orlando, FL (US)

(73) Assignee: Mattel, Inc., El Segundo, CA (US)

( * ) Notice: Subject to any disclaimer, the term of this patent is extended or adjusted under 35 U.S.C. 154(b) by 288 days.

(21) Appl. No.: 15/813,403

(22) Filed: Nov. 15, 2017

(65) Prior Publication Data

US 2019/0143234 A1 May 16, 2019

(51) Int. Cl.

| | |
|---|---|
| ***A63H 18/02*** | (2006.01) |
| ***A63H 18/14*** | (2006.01) |
| *A63H 17/14* | (2006.01) |

(52) U.S. Cl.

CPC ..... *A63H 18/025* (2013.01); *A63H 18/026* (2013.01); *A63H 18/028* (2013.01); *A63H 18/14* (2013.01); *A63H 17/14* (2013.01)

(58) Field of Classification Search

CPC ..... A63H 17/00; A63H 17/008; A63H 18/00; A63H 18/02; A63H 18/025; A63H 18/028; A63H 18/16

See application file for complete search history.

(56) References Cited

U.S. PATENT DOCUMENTS

| | | | | |
|---|---|---|---|---|
| 1,478,350 | A | 12/1923 | Okel | |
| 4,128,964 | A | 12/1978 | Ogasawara | |
| 4,312,149 | A | 1/1982 | Iwao | |
| 4,961,716 | A | 10/1990 | Hippely | |
| 5,643,040 | A | 7/1997 | Hippely | |
| 5,855,501 | A | 1/1999 | Kato | |
| 5,871,385 | A | 2/1999 | Hippely | |
| 7,628,674 | B2 * | 12/2009 | Nuttall | A63H 18/026 446/444 |
| 7,794,301 | B2 * | 9/2010 | Ostendorff | A63H 18/005 104/55 |
| 7,857,679 | B2 | 12/2010 | O'Connor | |
| 8,322,660 | B2 | 12/2012 | O'Connor | |
| 8,567,690 | B2 | 10/2013 | De La Torre | |

(Continued)

OTHER PUBLICATIONS

Mattel, Inc., Hot Wheels Shark Bite Bay Information Sheet, 2008, 1 page.

(Continued)

*Primary Examiner* — Robert J McCarry, Jr.

(74) *Attorney, Agent, or Firm* — Edell, Shapiro & Finnan, LLC

(57) ABSTRACT

A track set for a toy vehicle includes a track portion and an actuatable mechanism. The track portion defines a track path between a first end of the track portion and a second end of the track portion. The actuatable mechanism attempts to capture a toy vehicle as the toy vehicle moves along the track path, between the first end and the second end, in response to select triggerings generated by the toy vehicle traversing the track path. The actuatable mechanism removes the toy vehicle from the track portion when the actuatable mechanism captures the toy vehicle. The actuatable mechanism may include a carriage that captures the toy vehicle. The carriage is initially disposed in a rest position that is off-path from the track path and is selectively movable, along a carriage pathway, to an actuated position that is also off-path from the track path.

20 Claims, 13 Drawing Sheets

(56) References Cited

U.S. PATENT DOCUMENTS

| | | | |
|---|---|---|---|
| 8,690,632 | B2 | 4/2014 | O'Connor |
| 8,747,180 | B2 | 6/2014 | O'Connor |
| 8,814,628 | B2 | 8/2014 | O'Connor |
| 8,870,623 | B2 | 10/2014 | Ferreyra |
| 9,314,704 | B2 | 4/2016 | Ostendorff |
| 9,421,473 | B2 | 8/2016 | Ostendorff |
| 2008/0113585 | A1 | 5/2008 | Payne |
| 2011/0269372 | A1 | 11/2011 | Nuttall |
| 2016/0263488 | A1 | 9/2016 | Matthes |

OTHER PUBLICATIONS

Mattel, Inc., Hot Wheels Dragon Destroyer Information Sheet, 2012, 1 page.
Mattel, Inc., Hot Wheels Spider Man Speed Circuit Showdown Information Sheet, 2014, 6 pages.

* cited by examiner

TOY VEHICLE TRACK SET

FIELD OF THE INVENTION

The present invention relates to a toy vehicle track set, and in particular, to a toy vehicle track set with an accessory or mechanism that attempts to capture a toy vehicle as it moves along a track path and remove the toy vehicle from the track path.

BACKGROUND OF THE INVENTION

Conventional toy vehicle track sets include a section of track along which a toy vehicle can travel. In some track sets, accessories will act on a toy vehicle when the toy vehicle reaches the end of a track path (i.e., while the vehicle is stopped). For example, an accessory may move a toy vehicle from the end of one track to the beginning of another. However, the play value of an accessory acting on a vehicle at the end of a track path is limited. A need exists for a toy vehicle track set that further captures the attention and imagination of a user.

SUMMARY OF THE INVENTION

According to one embodiment, a track set for a toy vehicle includes a track portion and an actuatable mechanism. The track portion defines a track path between a first end of the track portion and a second end of the track portion. The actuatable mechanism attempts to capture a toy vehicle as the toy vehicle moves along the track path, between the first end and the second end, in response to select triggerings generated by the toy vehicle traversing the track path. The actuatable mechanism removes the toy vehicle from the track portion when the actuatable mechanism captures the toy vehicle.

In some of these embodiments, the track portion is part of a closed-loop track, such that the toy vehicle can return to the first end of the track portion when the actuatable mechanism does not remove the toy vehicle from the track portion. Additionally or alternatively, the track portion may be a curved track portion. In at least some of the embodiments with a curved track portion, the first end of the curved track portion is further above a support surface on which the track set is supported than the second end, such that the track path is descending.

According to other embodiments, an accessory for a toy vehicle track set includes a trigger assembly and a carriage. The trigger assembly that is disposed at a first end of a track portion and each time the toy vehicle traverses the first end of the track portion, the toy vehicle causes a triggering of the trigger assembly and each triggering causes a partial actuation or a complete actuation of the actuatable mechanism. The carriage traverses a carriage pathway to attempt to capture the toy vehicle in response to a complete actuation of the trigger assembly.

In at least some of these embodiments, the carriage pathway begins a distance above a track path provided by the track portion, converges on the track path so that the carriage can attempt to capture the toy vehicle as the toy vehicle moves along the track path, and terminates laterally exterior the track path so that subsequent toy vehicles may traverse the track path unimpeded. The distance above the track path may be greater than the height of the toy vehicle so that the toy vehicle can continue along the track portion unimpeded after a partial actuation of the trigger assembly. Additionally or alternatively, the carriage may include a rotatable lip that is biased to a downwardly extending position in which the lip creates a pathway for the toy vehicle to leave the track portion and enter the carriage.

Additionally or alternatively, the accessory may also include a central hub that is adjacent, but offset from, a center of curvature of the track portion. The central hub is rotatable about a vertical axis. In some of these embodiments, the accessory also includes an arm that extends from a proximal end to a distal end. The proximal end is coupled to the central hub and the distal end is fixedly coupled to the carriage. Still further, in some embodiments including the arm, the proximal end of the arm is rotatably coupled to the central hub about an axis that is orthogonal to the vertical axis and the accessory also includes a housing. The central hub rotates within the housing and the housing includes a top surface that defines a circumferential rail with undulations on which the arm may ride. The undulations of the rail control the angular displacement of the arm with respect to the top surface as the arm rotates, with the central hub, about the vertical axis. For example, in some embodiments, the arm includes a roller that rides along the circumferential rail as the arm rotates, with the central hub, about the vertical axis.

According to yet another embodiment, a toy vehicle track set includes a track portion and a carriage. The track portion defines a track path between a first end of the track portion and a second end of the track portion. The carriage that is initially disposed in a rest position that is off path from the track path and the carriage is selectively movable, along a carriage pathway, to an actuated position that is also off path from the track path. The carriage pathway converges on the track path so that the carriage can attempt to capture the toy vehicle, as the toy vehicle moves along the track path, when the carriage is selectively moved. Moreover, the toy vehicle can travel, unimpeded, along the track path when the carriage is in the rest position or the actuated position.

In some embodiments, this toy vehicle track set also includes a rotatable arm with a raised section. When the carriage is in the rest position, the rotatable arm supports the carriage a distance above the track path that allows the toy vehicle to travel along the track path unimpeded. When the carriage is in the actuated position, the rotatable arm supports the carriage in a position that is laterally offset from the track portion, with the raised section extending over the track portion at the distance above the track portion.

BRIEF DESCRIPTION OF THE DRAWINGS

Like reference numerals have been used to identify like elements throughout this disclosure.

DETAILED DESCRIPTION OF THE INVENTION

Figure 1:
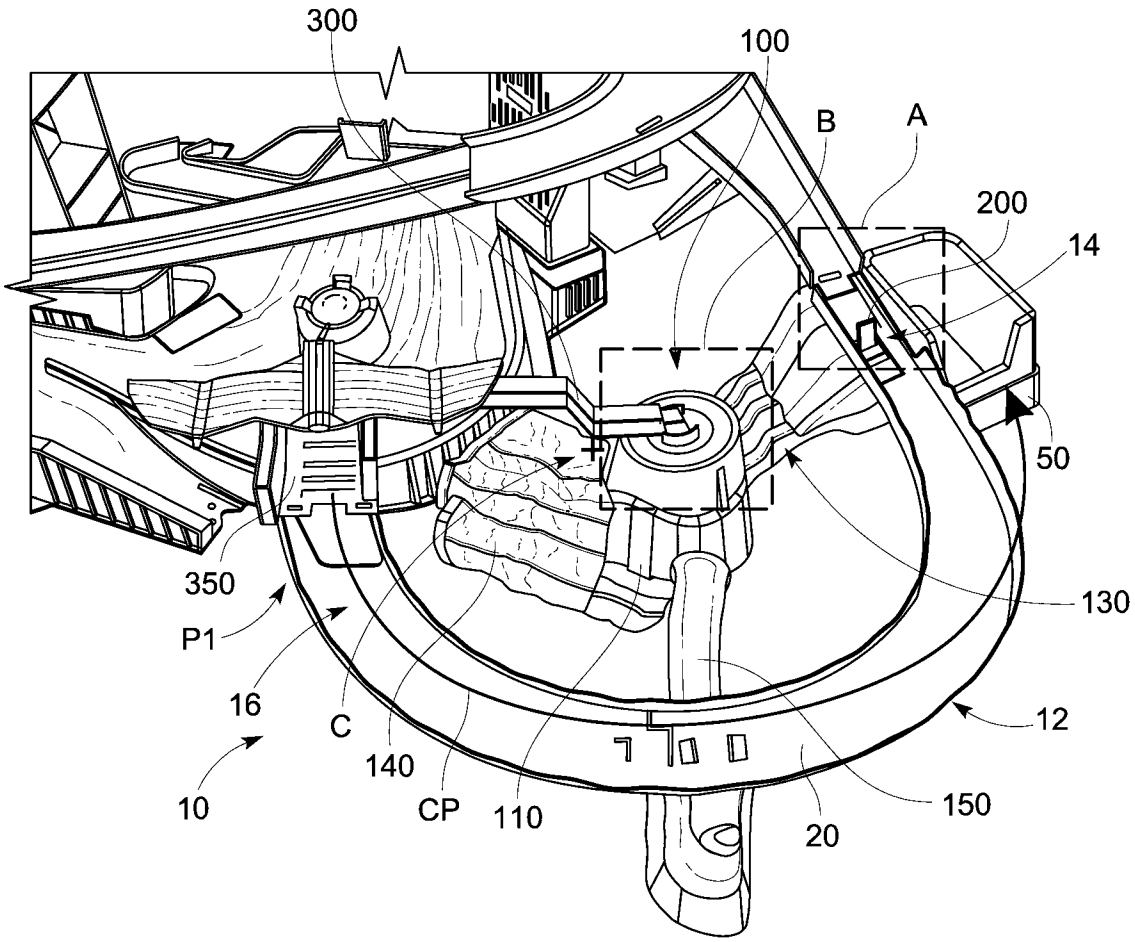
FIG. 1 illustrates a top perspective view of a portion of a toy vehicle track set according to an embodiment of the present invention.

Generally, a toy vehicle track set according to the present invention includes a mechanism or accessory that is configured to selectively and automatically attempt to capture a toy vehicle as it moves along a track path of the toy vehicle track set. That is, the mechanism or accessory may automatically (i.e., without user input)_attempt to capture a toy vehicle as the toy vehicle travels along a track path, but only in response to selective actuations of the accessory (triggered by the toy vehicle). After capturing the toy vehicle, the accessory (the terms accessory and mechanism may be used interchangeably herein) removes the toy vehicle from the track and clears that track path so that subsequent (i.e., uncaptured) toy vehicles may travel along the track path unimpeded. That is, the accessory moves off-path from a track path subsequent to capturing a toy vehicle. Moreover, the accessory may be off-path from the track path prior to capturing the toy vehicle so that any vehicle traveling along the track portion without completely actuating the accessory can travel along the track portion unimpeded.

In order to provide these aforementioned features in an interesting manner, the accessory includes a carriage that travels along a carriage pathway that is distinct from, but converges with, at least temporarily, the track path defined by the track portion. In some embodiments, the path of travel for the carriage is in an opposite direction to the path of travel for a toy vehicle on the track portion. For example, a carriage may be traveling left-to-right, while the toy vehicle is traveling from right-to-left from a particular perspective. Prior to and subsequent to traveling along the carriage pathway, the carriage is off-path from the track path. For example, the carriage may initially be positioned above the track portion, at a height sufficient to allow toy vehicles traveling along the track portion to travel beneath the carriage unimpeded. Then, when the accessory is completely actuated (as opposed to a partial actuation, each of which are described in detail below), the carriage automatically moves towards the track path along the carriage pathway, attempts to capture the vehicle, and moves laterally exterior of the track path. Consequently, the carriage appears to swoop down onto the track and attempt to capture the toy vehicle as the toy vehicle is moving between the first end and second end of the track path (as opposed to simply capturing a toy vehicle at an end of track path).

As alluded to, the carriage does not attempt to capture every toy vehicle moving along the track portion with which it is associated. Instead, the carriage may only attempt to capture toy vehicles when a toy vehicle triggers a complete actuation of a trigger assembly included in the accessory (as opposed to a partial actuation). Even when the toy vehicle triggers a complete actuation, the carriage still may not capture the toy vehicle, e.g., if the toy vehicle is going too fast or too slow compared to the carriage. To effectuate the selective actuation, the trigger assembly includes a randomizer subassembly. The randomizer subassembly allows the trigger assembly to partially or completely (i.e., fully) actuate in response to a toy vehicle traversing the track portion. As is explained in further detail below, only complete actuations of the trigger assembly release the carriage to swoop onto the track portion and attempt to capture a toy vehicle as it travels along a track path defined by the track portion. The toy vehicle need not exhibit any special characteristics to cause a complete actuation; instead the trigger assembly may randomly create partial and complete actuations in response to the identical triggers from toy vehicles. This adds an element of surprise and/or intrigue to the toy vehicle track set.

Figure 2:
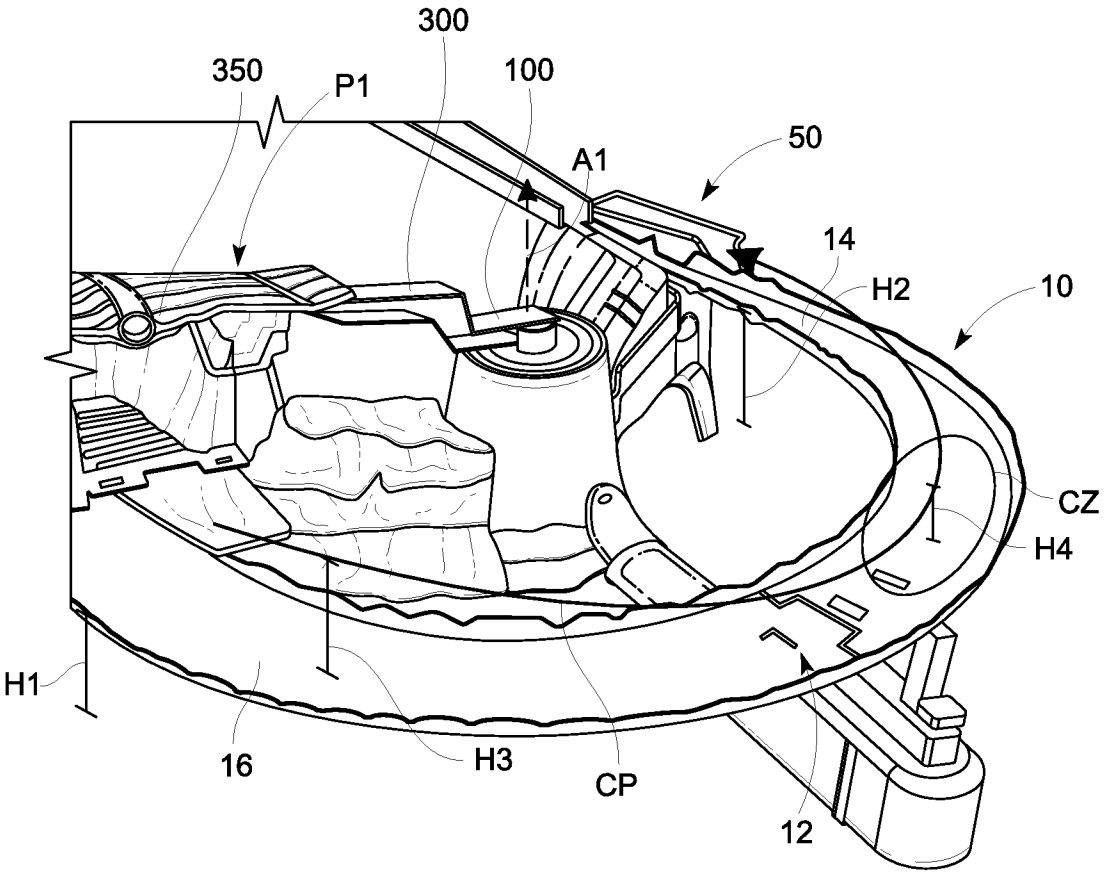
FIG. 2 illustrates a side perspective view of the portion of the toy vehicle track set shown in FIG. 1.

Now referring to FIGS. 1 and 2, these two figures illustrate a toy vehicle track set 10 according to an example embodiment of the present invention. The track set 10 includes a track portion 12 (also referred to simply as track 12) and an accessory 100 (as mentioned, the accessory 100 may also be referred to as mechanism 100). The accessory 100 includes trigger assembly 200, an arm assembly 300 and a carriage 350, each of which are explained in detail below. Meanwhile, the track portion 12 defines a track path 20 (also referred to as track path 20) along which a toy vehicle may travel when traversing the toy vehicle track set 10. In the depicted embodiment, the track path 20 is defined between two sidewalls; however, in other embodiments, track path 20 may be defined on a track portion 12 in any manner (i.e., rails for a train or an I-beam type feature for a plane-type vehicle with mating features).

In the depicted embodiment, the track 12 is a descending, curved track 12. The track 12 descends from a first end 14 with a height H1 (i.e., the first end 14 is located at a distance H1 above a support surface on which the track set 10 is disposed) to a second end 16 with a height H2 (i.e., the second end 16 is located at a distance H2 above the support surface) and H2 is smaller or shorter than H1. Thus, the track portion 12 descends from the first end 14 to the second end 16. Meanwhile, the track 12 is generally curved around a single center of curvature that is approximated at point "C" in FIG. 1. In other embodiments, the track portion 12 need not include a uniform or symmetrical curve and/or need not be a descending track portion. However, the shape/configuration of the track portion 12 should allow the mechanism 100 to move its carriage 350 along a carriage pathway "CP". The mechanism 100 moves the carriage 350 from a first off-path position P1, into the track path 20, and to a second off-path position P2. When the carriage 350 is in the "off-path position", it does not impede the track path 20 and allows a toy vehicle to travel along the track path 20 unimpeded.

As a more specific example, in the depicted embodiment, the carriage 350 is initially in a first off-path position P1 (i.e., a rest or unactuated position P1) that is laterally aligned, but vertically spaced from the track path 20. In particular, the carriage 350 is positioned a distance H3 (see FIG. 2) above the track 12 that is taller than a conventional toy vehicle used with the track set 10 so that a conventional toy vehicle may travel along the track path 20 unimpeded when the carriage is in position P1. Then, when the mechanism 100 is completely actuated (which is explained in further detail below), the carriage 350 moves along the carriage pathway CP in a first direction and, for at least a moment, converges with the track path 20, insofar as the term converge is used to indicate that the carriage 350 is close enough to track 12 to capture a toy vehicle traveling in the track path 20 in a second direction opposite to the first direction.

In FIG. 2, the carriage pathway CP converges with the track path 20 throughout a convergence zone "CZ." In the convergence zone CZ, the carriage 350 is separated from the track 12 by a distance that is less than or equal to height H4, which may be a height that is less than or equal to a distance the carriage 350 can extend downwards. More specifically, a bottom 351 of the carriage 350 (see FIG. 3) may be separated from a bottom surface of the track 12 (the bottom surface being the surface that, together with the sidewalls, defines the track path 20) by a distance H4 that is less than or equal to the distance a lip 354 (see FIG. 3) can extend downwards from the bottom 351 of the carriage 350.

After the carriage 350 moves through the convergence zone CZ, the carriage 350 continues along the carriage pathway CP to its second off-path position P2 (i.e., its actuated position P2). In the depicted embodiment, the second off-path position P2 is laterally offset from the track path 20 (i.e., beside track path 20). Consequently, the carriage 350 does not impede track path 20 when the carriage 350 is in the second off-path position P2. The arm assembly 300 of the mechanism is also off-path from the track path 20 when the carriage is in its actuated position P2, as is explained in further detail below. Thus, any toy vehicles traversing the track portion 12 subsequent to actuation of the mechanism 100 can travel down the track path 20 unimpeded.

Although FIGS. 1 and 2 only show a portion of the track set 10, the track set 10 may be a closed-loop track set or an open-ended track set. In embodiments where the track set 10 is a closed-loop track set, the track portion 12 may be part of the closed-loop track, and the toy vehicle may be able to return to a first end 14 of the track portion 12 when the mechanism 100 does not remove the toy vehicle from the track portion (i.e., when the toy vehicle triggers a partial actuation of the trigger assembly, as is explained in further detail below).

Still referring to FIGS. 1 and 2, to provide the aforementioned off-path positions, at least a portion of the mechanism 100 is mounted within a central housing 110 that is, at least slightly, off-center from the center of curvature C of the curved track 12. More specifically, the central housing 110 is, at least slightly closer to the first end 14 of the track than the second end 16. Consequently, when the mechanism 100 rotates the arm assembly 300 about a vertical axis A1 (see FIG. 2) the carriage 350 may be laterally aligned with the second end 16 of the track 12 and may be laterally offset from the first end 14 of the track 12. That being said, in other embodiments, the central housing 110 may be aligned with the center of curvature C of the track 12, such that axis A1 is coaxial with the center C. In these embodiments, the mechanism 100 may utilize angular displacement of the arm assembly 300 (which is discussed in further detail below) to move the carriage 350 to suitable off-path positions (i.e., the mechanism 100 may tilt the arm assembly 300 to different angles with respect to axis A1 (and with respect to a top of the housing 110) to shorten or lengthen the arm assembly 300 with respect to the track 12).

Regardless of the exact position of the central housing 110, the central housing 110 is coupled to the first end by a trigger assembly extension 130. The trigger assembly extension 130 may include various features, supports, or artifacts to allow the trigger assembly 200 to selectively unlock (i.e., release) the arm assembly 300 and allow the arm assembly 300 to move the carriage 350 along the carriage pathway CP (and through the convergence zone CZ). The trigger assembly extension 130 may also serve as a connection between the central housing 110 and a compartment 50 that is disposed laterally exterior of both the trigger assembly 200 and the first portion 14 of the track 12.

As is explained in further detail below, the compartment 50 may be configured to receive a toy vehicle after the toy vehicle is captured by the carriage 350 and removed from the track path 20. For example, the compartment 50 may catch a toy vehicle when the carriage 350 stops at off-path position P2 and the toy vehicle's momentum carries the toy vehicle out of the carriage 350. Still further, the accessory may also include supports 140 and 150 to connect the accessory to a base of the track set 10 and a central portion of the track 12, respectively. Supports 140 and 150 may ensure that the mechanism 100 is properly positioned with respect to the track 12 and may also add structural integrity to the track set 10 as a whole.

Figure 3:
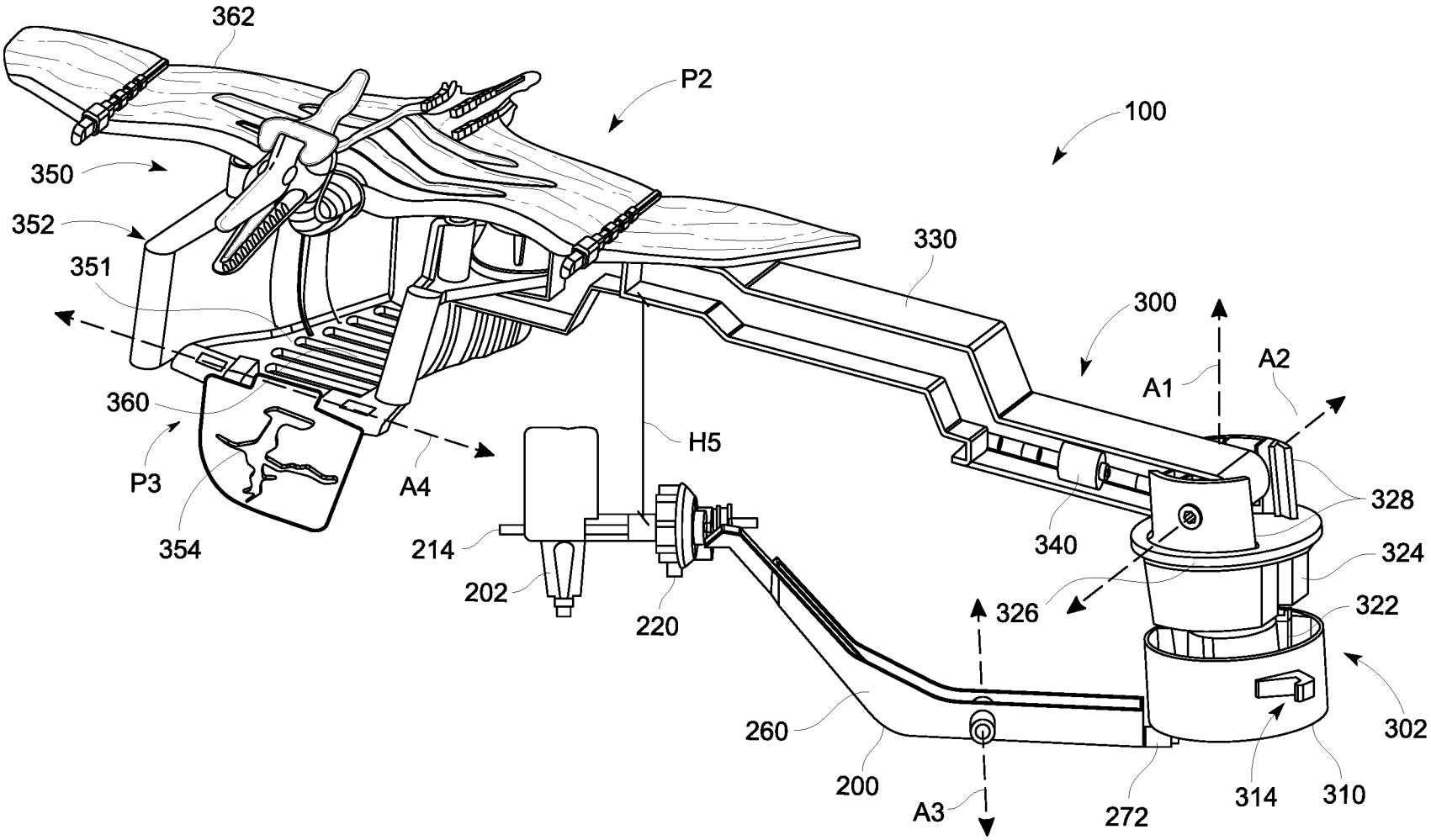
FIG. 3 illustrates a front perspective view of a mechanism or accessory included in the toy vehicle track set of FIG. 1.
Figure 4:
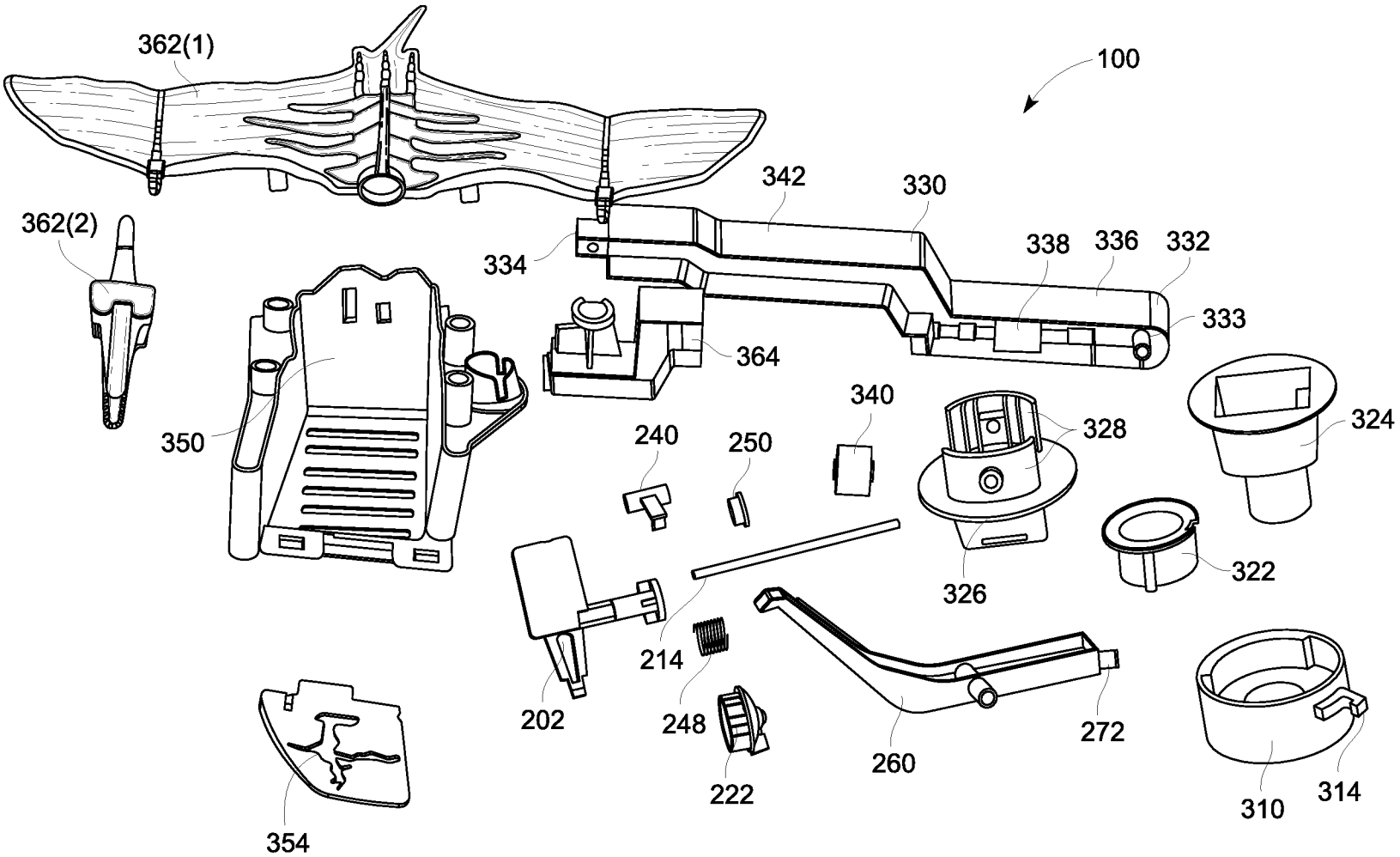
FIG. 4 illustrates an exploded perspective view of the mechanism of FIG. 3.
Figure 5:
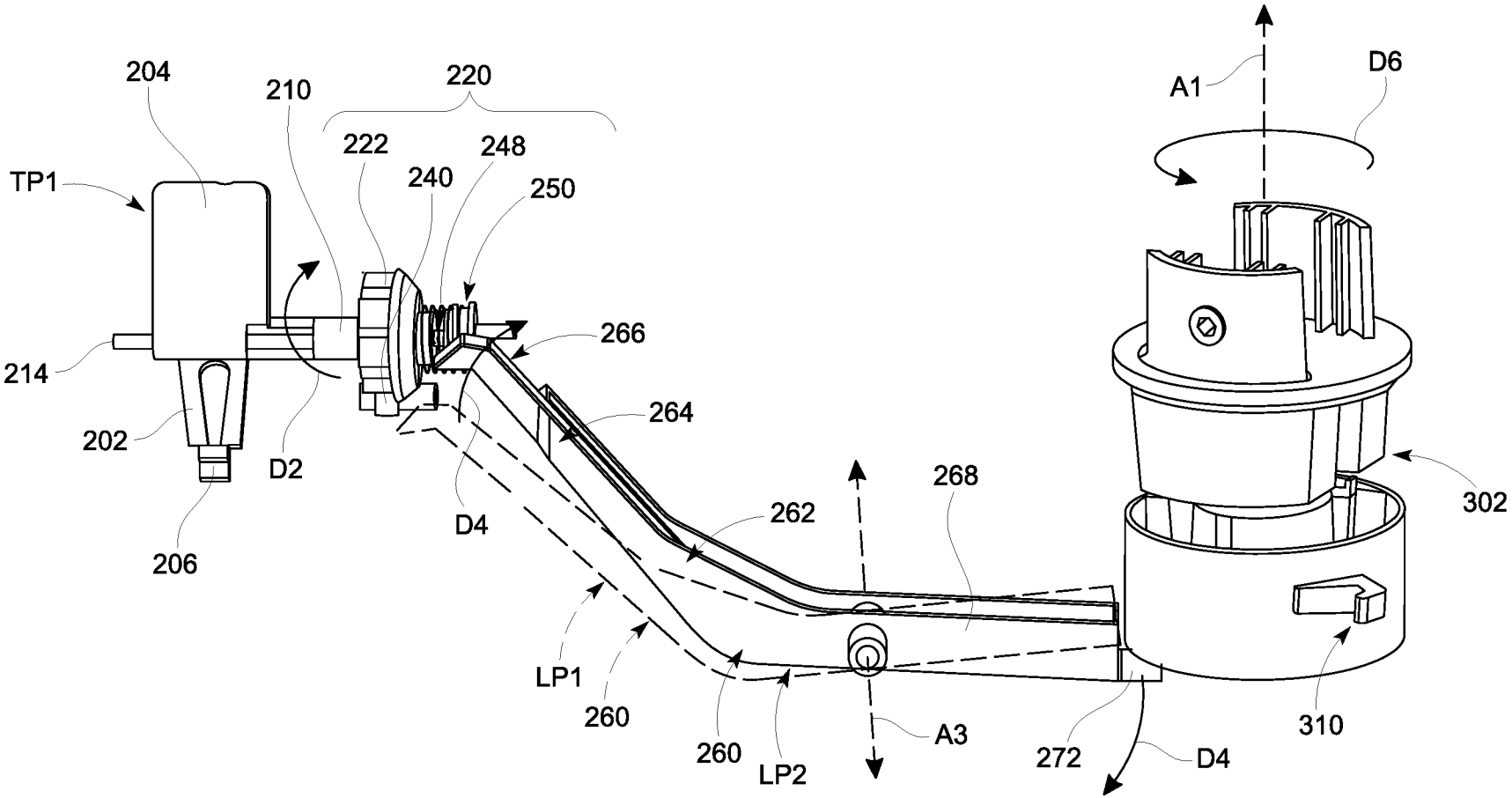
FIG. 5 illustrates a front perspective view of a trigger assembly and a portion of an arm assembly included in the mechanism of FIG. 3.

Now turning primarily to FIGS. 3-5, as mentioned, the mechanism 100 includes a trigger assembly 200, an arm assembly 300 and a carriage 350. At a high-level, the trigger assembly 200 includes a trigger member 202, a randomizer subassembly 220, and a lever arm 260 (also referred to as lever 260). The trigger member 202 and most of the components of the randomizer subassembly 220 are mounted on an axle 214. In particular, and as can be seen in FIGS. 4 and 5, the randomizer subassembly 220 includes a randomizer gear 222 (also referred to as a randomizer component 222), a lateral biasing member 248, and a stop member 250 and each of these components is mounted on the axle 214. Consequently, each of these components, as well as the trigger member 202, is rotatable around an axis A5 that is coaxial with axle 214, as is shown clearly in FIGS. 7 and 8 (these components may rotate with or around the axle 214).

Figure 8:
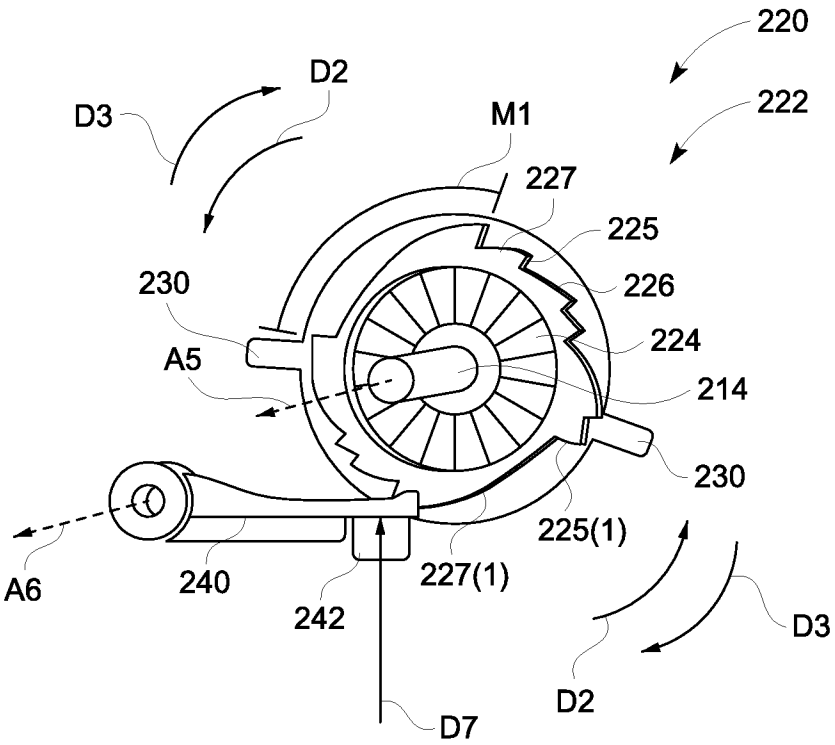
FIG. 8 illustrates a left side view of a randomizer subassembly included in the trigger assembly of FIG. 5.
Figure 10:
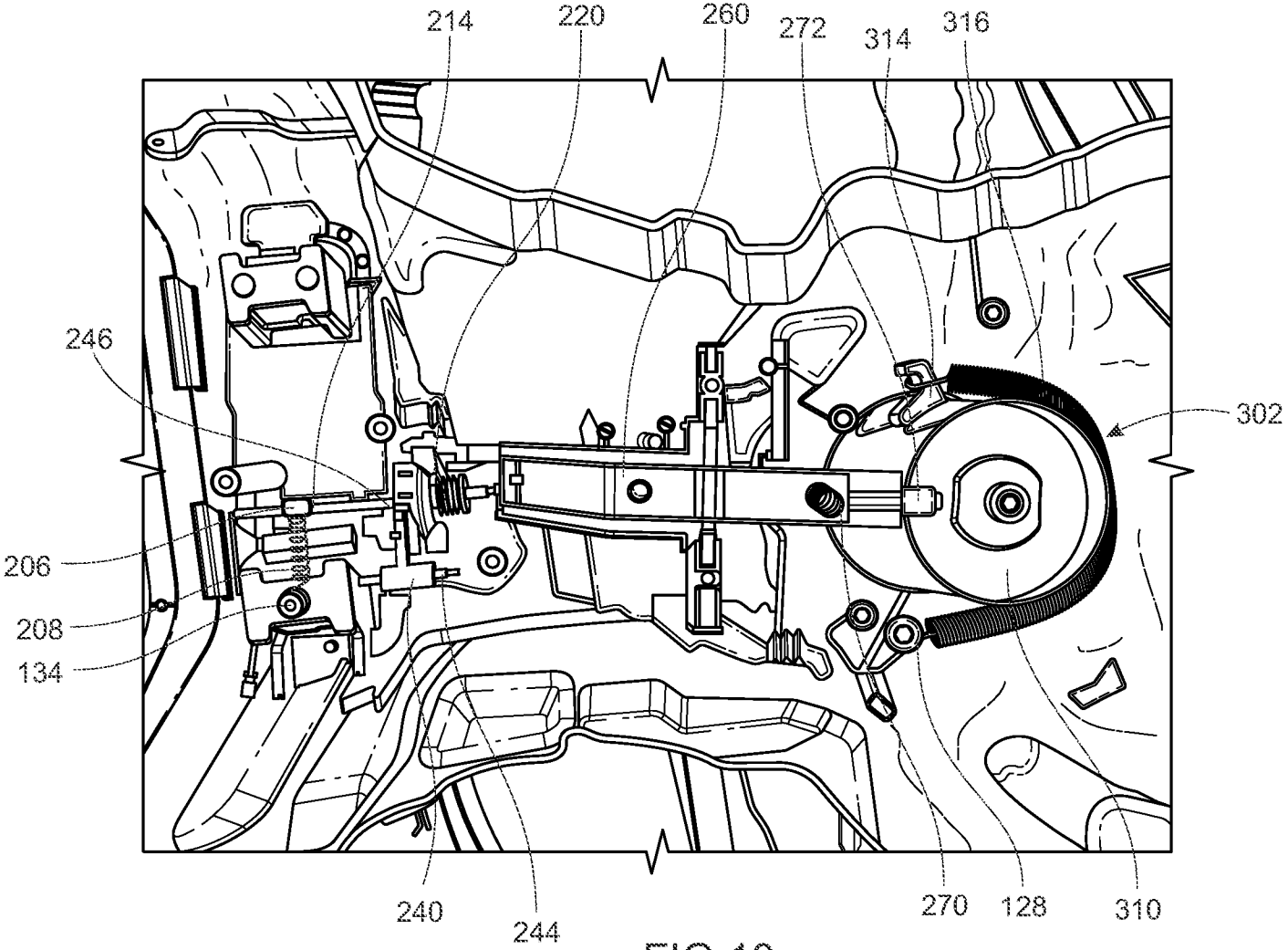
FIG. 10 illustrates a bottom view of the trigger assembly and the portion of the arm assembly from FIG. 5 installed in the toy vehicle track set from FIG. 1.

Additionally, the randomizer subassembly 220 includes a clutch member 240 that is biased into engagement with the randomizer component 222 by a longitudinal biasing member 246 (see FIG. 10), as is described in further detail below. The clutch member 240 is mounted on an axle 244 that is parallel to, but offset from axle 214 (as shown in FIG. 10). Consequently, the clutch member 240 is rotatable around an axis A6 that is parallel to and offset from axis A5, as shown in FIG. 8. Generally, the lever 260 is selectively actuated (and caused to rotate about axis A3) by the randomizer gear 222. The lever 260 includes a lock member 272 that can selectively lock or prevent the arm assembly 300 from rotating, as is also described in further detail below.

Meanwhile, the arm assembly 300 includes a rotating hub 302 and an arm 330. The rotating hub 302 (also referred to as a central hub 302) includes a base portion 310, a first mid-section 322, a second mid-section 324, and a top 326. The base portion 310 includes a notch 312 (see FIG. 12) that may be selectively engaged by the lock member 272 included on the lever 260. The base portion 310 also includes a hook 314, on which a biasing member 316 can be coupled to the base portion 310 (see FIG. 11). Each of these features is described in described in further detail below. The top 326 includes mounting flanges 328 that are configured to receive an axle 327 (see FIG. 13) on which the arm 330 can be mounted. Consequently, the arm 330 may be rotatable about a horizontal axis A2 that allows a distal end 334 of the arm 330 to move vertically as the rotatable hub rotates 302 rotates the arm 330 about the vertical axis A1. In at least some embodiments, the mid-sections 322 and 324 may also allow vertical displacement of the top 326 with respect to the base 310, either in addition to or in lieu of the rotational movement of the arm 330 about axis A2.

The arm 330 extends from a first or proximal end 332 to the second or distal end 334 and includes a first section 336 and a second section 342. The proximal end 332 is rotatably coupled to the rotating hub 302 and the distal end 334 is fixedly coupled to the carriage 350. More specifically, the first section 336 includes an opening 333 that is sized to receive axle 327 (see FIG. 13) that extends between the mounting flanges 328 and this axle rotatably couples the proximal end 32 to the central hub 302 about axis A2.

The first section 336 of the arm 330 also includes an opening 338 sized for a roller 340. The roller 340 is configured to ride on a rail 120 included on a top surface 118 of the central housing 110 (see FIG. 13) and undulations or slopes in the rail 120 may control the angular displacement of the arm 330 with respect to the top surface 118 of the central housing 110 (as well as the top 326 of the rotating hub 302 and the vertical axis A1) as the arm 330 rotates, with the central hub 302, about the vertical axis A1.

The second section 342 of the arm 330 is raised with respect to the first section 336 (and may be referred to as raised section 342 and, thus, is spaced from the axle 214 by the distance H5. Notably, since FIG. 3 illustrates the arm assembly 300 supporting the carriage 350 in the second off-path position P2 and the axle 214 is approximately flush with the track portion 12, distance H5 signifies the distance between the track path 20 and the raised section 342 of the arm 330. This distance, like distance H3 in FIG. 2, is taller than a conventional toy vehicle. Consequently, a conventional toy vehicle may travel along the track path 20 unimpeded by the arm 330 when the carriage 350 is in position P2.

Still referring to FIGS. 3-5, the carriage 350 includes a bottom 351 and a wall 352 that collectively define a receptacle 360 within which a toy vehicle can be captured. That is, the receptacle 360 is sized to receive a toy vehicle. In the depicted embodiment, the wall 352 extends around a back and both sides of the receptacle 360, but the receptacle 360 includes an open front and a front lip 354 that is biased to a downwardly extending position P3. Consequently, when the carrier 350 moves into the convergence zone CZ (see FIG. 2), the front lip 354 may contact the track 14 and create a pathway for the toy vehicle to enter the receptacle 360. If the carrier 350 moves closer to the track 14 after the front lip 354 has contacted the track 14 (i.e., as the carrier 350 moves to a distance shorter than H4), the front lip 354 may begin to rotate upwards, around axis D4 to maintain the pathway. Then, as the carrier 350 moves away from the track 14, a biasing member (not shown) may urge the lip 354 back towards its downwardly extending position P3. Consequently, the lip 354 may provide a pathway into the receptacle 360 of the carriage 350 whenever the bottom 351 of the carriage 350 is separated from the track 12 by a distance less than or equal to H4.

In the depicted embodiment, the carrier 350 also includes a roof 362 that is shaped as a pterodactyl. As is shown in FIG. 4, the pterodactyl figure may be formed from two portions: 362(1) and 362(2). However, in other embodiments, the carrier 350 may include a roof 362 that resembles any desirable character, animal, creature, figurine, etc. and the roof 362 may be formed from one piece, multiple pieces, or formed integrally with the remainder of the carrier 350. Still further, the carrier 350 need not include a roof 362. Similarly, in the depicted embodiment, the carrier 350 is fixedly coupled to the arm 330 via a mount 364, but, in other embodiments, the carrier 350 may be coupled to the distal end 342 of the arm 330 in any manner, with or without a mount 364.

Figure 6:
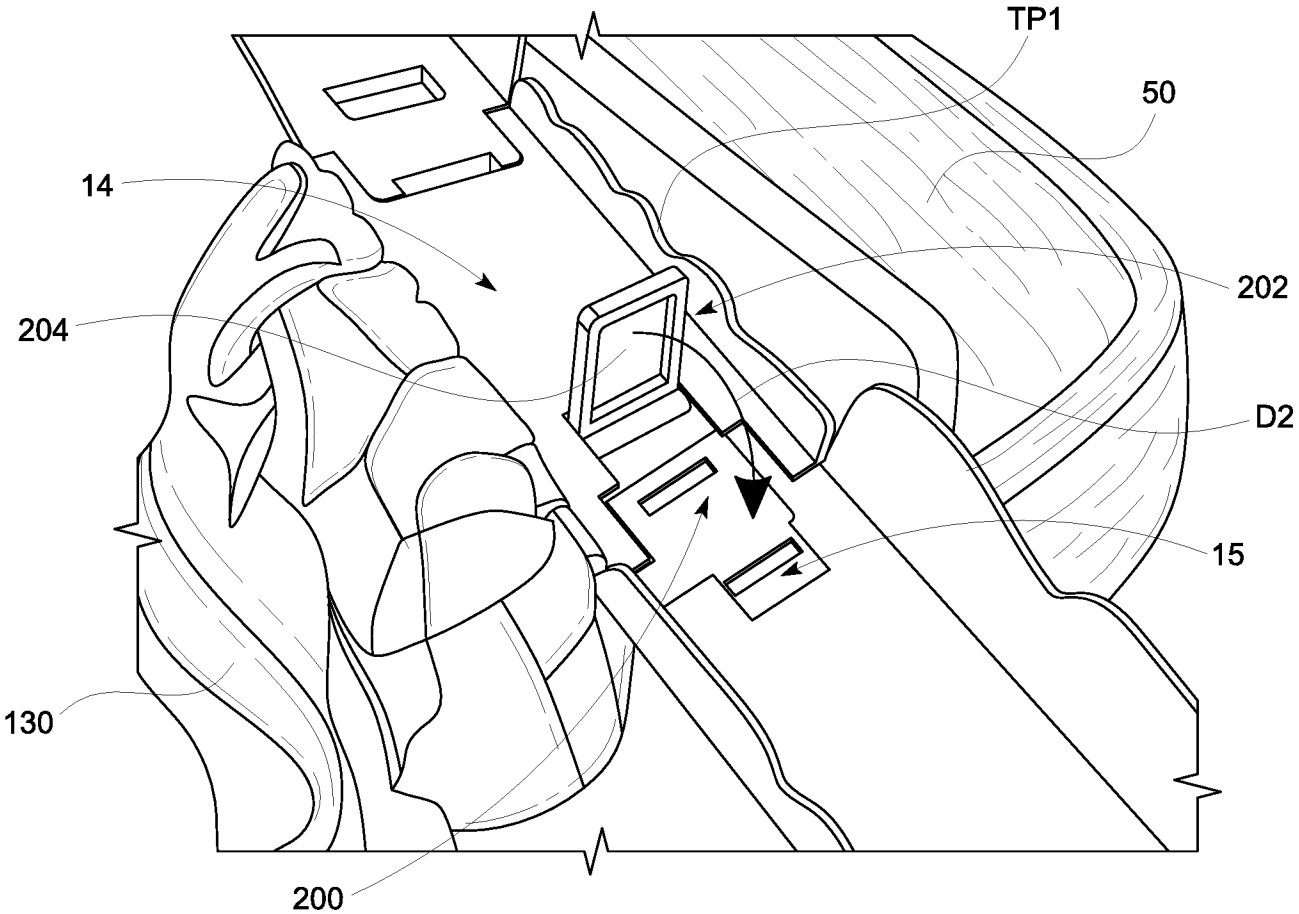
FIG. 6 illustrates a close-up perspective view of inset A from FIG. 1 that shows exposed components of the trigger assembly.

Now turning to FIGS. 5 and 6, generally, the trigger assembly 200 can be partially or completely actuated, but only complete (i.e. full) actuations of the trigger assembly 200 release/unlock the arm assembly 300 so that the arm assembly 300 moves the carriage 350 from its first off-path position P1 to its second off-path position P2. However, and intriguingly, due to the randomizer subassembly 220, identical triggers of the trigger member 202 cause partial actuations and complete actuations of the trigger assembly 200. That is, any toy vehicle traversing the first end 14 of the track 12 may trigger the trigger member 202 in the same manner, but the triggering may randomly cause complete actuations. Put still another way, the complete actuations may be random from the perspective of the user but may, in actuality simply be irregular or separated by one or more partial actuations (the number of partial actuations between complete actuations may be fixed or varied, but is preferably varied).

As a more specific example, in the depicted embodiment, each time a toy vehicle traverses the first section 14 of the track, the toy vehicle engages an extension 204 of the trigger member 202 (of the trigger assembly 200) that extends above the track, as is shown in FIG. 6 (which is a close-up view of inset A from FIG. 1). Then, the toy vehicle pushes the extension 204 downwards, towards the track 12, in direction D2 (the extension 204 rotates about the axis A5 that is coaxial with axle 214). However, even though each toy vehicle triggers the trigger member 202 (via the extension 204) when traversing the first section 14 of the track 12, each triggering of the trigger member 202 does not necessarily cause the lever 260 to move from an unactuated position LP1 (shown in dashed lines) to an actuated position LP2. Instead, the randomizer subassembly 220 determine which triggerings of the trigger member 202 cause the lever 260 to move from its unactuated position LP1 to its actuated position LP2. That being said, since a toy vehicle triggers the trigger assembly 200 while moving along the track path, triggerings of the trigger assembly 200 and/or actuations of the accessory 100 (whether complete or partial) may be said to be automatic at least because the triggerings/actuations are automatic in response to a toy vehicle traveling along the track path and do not require user input (i.e., a human pressing a button).

Figure 7:
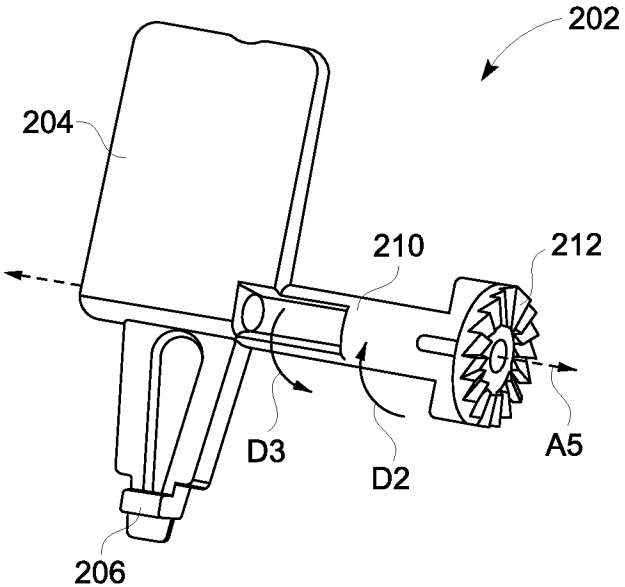
FIG. 7 illustrates a front perspective view of a trigger member included in the trigger assembly of FIG. 5.

Turning briefly to FIG. 7, the trigger member 202 includes the extension 204, a biasing support 206, an elongate member 210, and a crown gear 212. As mentioned above, the extension 204 extends above the track 12, into the track path 20 of a toy vehicle traversing the track 12. The remaining features of the trigger member 202 (i.e., the biasing support 206, the elongate member 210, and the crown gear 212) are formed integrally with or fixedly coupled to the extension 204. Consequently, the trigger member 202 rotates as one piece, around axis A5 that is coaxial with the axle 214 when a toy vehicle engages the extension 204 and pushes the extension in direction D2.

Now turning briefly to FIG. 8, the randomizer gear 222 includes a set of internal teeth 224, a set of external teeth 226, and two actuating flanges 230. The internal teeth 224 are substantially uniform and are configured to mesh with teeth included on the crown gear 212. By comparison, the external teeth 226 are non-uniform or irregular and are arranged to interact with the clutch member 240. In particular, the external teeth 226 define a plurality of stops 225 and tapered surfaces 227. The tapered surfaces 227 extend between the stops 225, and the clutch member 240 includes an engagement end 242 that is biased in an upwards direction D7, towards the external teeth 226 so that the engagement end 242 can engage any one of the stops 225. When the clutch member 240 is engaged with one of the stops 225, the clutch member 240 may prevent the randomizer gear 222 from rotating in direction D3. By comparison, due to the shape of the stops 225 and tapered surfaces 227, the clutch member 240 may not limit or impact the movement of the randomizer gear in direction D2. Notably, although direction D2 appears to be a counter-clockwise direction in FIG. 8, direction D2 is considered to be a clockwise direction when the trigger assembly 200 is viewed from a front or right perspective. The particular left side perspective view shown in FIG. 8 simply causes direction D2 to appear counter-clockwise in FIG. 8 (and vice versa for direction D3).

Now referring back to FIGS. 5 and 6, but with continued reference to FIGS. 7 and 8, as mentioned, initially, a toy vehicle traverses the first section 14 of the track, engages the extension 204 of the trigger member 202, and pushes the extension 204 downwards, towards the track 12, in direction D2. In fact, in the depicted embodiment, the first end 14 of the track 12 defines a cavity 15 (see FIG. 6) that allows the extension 204 to move into alignment with the track 12 during triggering by a toy vehicle. However, in the depicted embodiment, the trigger member 202 may be biased to an upward trigger position TP1 by a biasing member 208 (see FIG. 10) that is extends between the biasing support 206 of the trigger member 202 and a post 134 included in the trigger extension housing 130 (see FIG. 10). Thus, the extension 204 may only be disposed within the cavity 15 when a toy vehicle is acting on the extension 204.

That all being said, when a vehicle pushes the extension 204 in direction D2, the entire trigger member 202 may rotate about axis A5 (i.e., axle 214 may be a fixed axle and the trigger member 202 may rotate on the axle 214). Due to this rotation, the crown gear 212 meshes with the internal teeth 224 of the randomizer gear 222 and causes the randomizer gear 222 to also rotate in direction D2. More specifically, triggering the trigger member 202 (by a toy vehicle) may cause the trigger member 202 and randomizer gear 222 to rotate a radial distance that is greater than an arc length M1 (see FIG. 8) of the longest tapered surface 227 included in the external teeth 226 of the randomizer gear 222 (for clarity, one of two tapered surfaces that are both the longest tapered surface 227 of the depicted embodiment is labeled as 227(1), while the other is labeled with the measurement M1).

As mentioned, the clutch member 240 does not impact or impede the rotation of the randomizer gear 222 in direction D2. Instead, the engagement end 242 of the clutch 240 rides along the tapered surfaces 227, over any interceding stops 225, when the randomizer gear rotates in direction D2. Consequently, if the clutch 240 is engaged with a stop 225(1) that defines the lower end of one of the longest tapered sections 227(1) prior to triggering of the trigger member 202, the clutch 240 may traverse the entire tapered section 227(1) during the triggering. When a triggering of the trigger member 202 causes the randomizer gear to rotate enough in direction D2 so that the actuating flanges 230 displace the lever 260, this triggering is considered a complete actuation. If, instead, a triggering simply advances the actuating flanges 230 towards the lever 260, this may be considered a partial actuation. In the depicted embodiment, the triggering immediately after a triggering that causes the engagement end 242 to traverse one of the longest tapered sections 227(1) causes a complete actuation, as is discussed in further detail below.

Ignoring, for the moment, the interplay of the actuating flanges 230 of the randomizer gear 222 and the lever 260, once a vehicle completes an actuation of the trigger member 202 and moves out of engagement with the extension 204, the biasing member 208 (see FIG. 10) acts on the biasing support 206 of the trigger member 202 to urge the trigger member 202 back to its upward trigger position TP1. That is, when a toy vehicle is no longer exerting a force on the extension 204, the trigger member begins to rotate in direction D3. Consequently, the crown gear 212 meshes with the internal teeth 224 of the randomizer gear 222 and urges the randomizer gear 222 to also rotate in direction D3. However, as mentioned, at some point, the clutch member 240 may act against this rotation. That is, when rotation of the randomizer gear 222 in direction D3 brings a stop 225 into engagement with the engagement end 242 of the clutch member 240, the clutch member 240 may prevent further rotation of the randomizer gear in direction D3.

When the clutch member 240 begins preventing further rotation in direction D3, the action of the crown gear 212 against the internal teeth 224 of the randomizer gear may cause lateral displacement of the randomizer gear 222 towards the stop member 250. The lateral biasing member 248 may resist this lateral movement and urge the randomizer gear 222 back into engagement with the clutch member 240; however, this lateral movement may allow the randomizer gear 222 to set a start point for its next rotation in direction D2 (i.e., its next forward rotation) without preventing the crown gear 212 and the internal teeth 224 from locking up while the trigger member 202 rotates back to the upward trigger position TP1.

Still referring to FIGS. 5-8, but now with an emphasis on FIG. 8, due to the configuration of the external teeth 226, the clutch member 240 allows the randomizer gear to rotate irregular radial distances in direction D3 (i.e., backwards rotation) subsequent to a triggering of the trigger member 202. Consequently, the randomizer gear 220 may begin a second rotation in direction D2 from a location that is different (i.e., radially offset) from a location in which a first rotation in direction D2 ended.

For example, if the randomizer gear 222 is positioned in the position shown in FIG. 8 subsequent to a triggering of the trigger assembly 202 (i.e., subsequent to a forward rotation of the trigger member 202 and randomizer gear 222 in direction D2), the randomizer gear 222 may rotate backwards with the trigger member 202 in direction D3 until the engagement end 242 of the clutch member 240 engages stop 225(1). Once the engagement end 242 engages stop 225(1) the trigger member 202 may finish rotating back to the upward trigger position TP1 alone (i.e., without simultaneous rotating the randomizer gear 222 further in direction D3). Then, when the trigger member 202 is triggered again (i.e., moved in direction D2 by a toy vehicle), the trigger member 202 will begin to rotate the randomizer gear 222 in direction D2 from stop 225(1), instead of the position shown in FIG. 8 (where the randomizer gear 222 finished its last forward rotation in direction D2).

If, instead, the engagement end 242 of the clutch member 240 is engaged with a stop 225 immediately after a triggering of the trigger member 202 (i.e., after the trigger member 202 and randomizer gear 222 rotate in direction D2), the clutch member 240 may prevent the randomizer gear 222 from rotating any amount in direction D3 and the randomizer gear 22 may begin its next rotation in direction D2 from its current location (the trigger member 202 may be the only component that rotates in direction D3 between the two triggerings of the trigger member 202).

Notably, this irregular reverse rotation of the randomizer gear 222 allows the randomizer gear 222 to randomly or irregularly actuate the lever 260 (i.e., to irregularly cause complete actuations). This is because each rotation of the randomizer gear 222 in direction D2 (i.e., each clockwise of forward rotation of randomizer gear 222) may begin from a random location and, thus, the forward rotations may not build upon each other in a purely incremental manner. For example, if each triggering of the trigger member causes a rotation in direction D2 of 90 degrees, four triggerings may not rotate the randomizer gear through 360 degrees of rotation. Instead, the randomizer gear 222 may slip backwards between forward rotations so that four forward rotations create a total angular rotation that is less than 360 degrees (i.e., a total angular rotation of 270 degrees). Consequently, the actuating flanges 230 may not interact with the lever 260 on every triggering or even every X number of triggerings. Instead, a random number of triggerings may move the randomizer gear 222 through 180 degrees of rotation so that the actuating flanges 230, which are separated from each other by 180 degrees, rotate into engagement with the lever 260 after a random number of triggerings of the trigger member 202.

Figure 9:
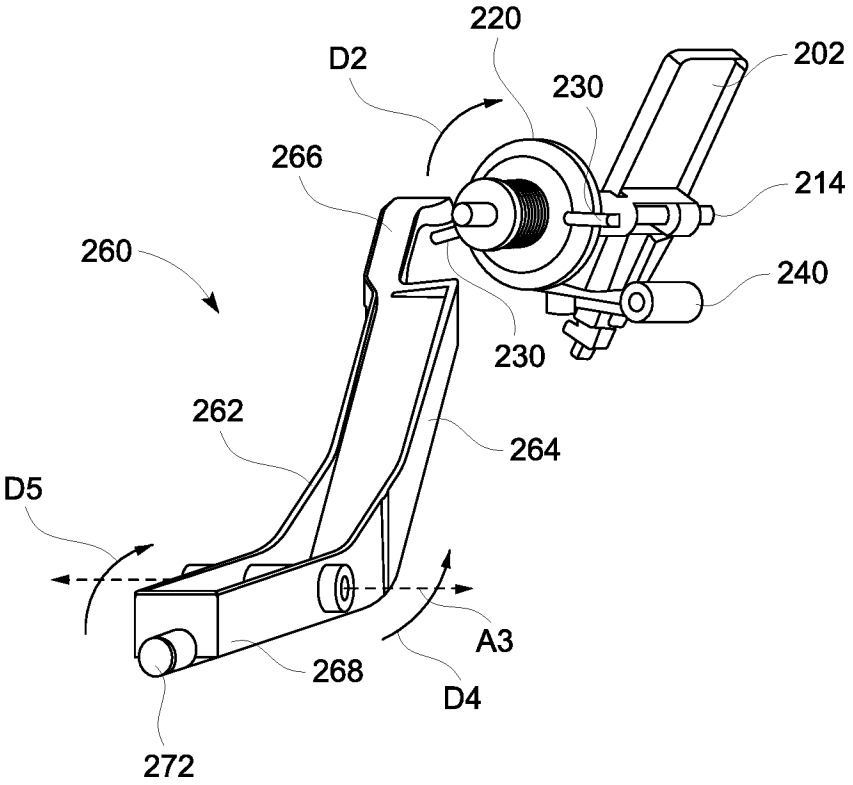
FIG. 9 illustrates a right side perspective view of the trigger assembly of FIG. 5.

More specifically, and now referring to FIG. 5 in combination with FIG. 9, the lever 260 includes a main body 262 with a first linear section 264 and a second linear section 268 that are askew with respect to each other. The first linear section 264 includes a flange 266 which extends from a lateral edge of the first linear section 262, as can be seen in FIG. 9. The second linear section 268 includes a lock member 272 that extends from a central portion of its distal end and also defines various features to support a biasing member 270 (see FIG. 10) and an axle (not shown) that defines a lever pivot axis A3. The biasing member 270 biases the lever 260 to its unactuated position LP1 (shown in dashed lines). When the lever 260 is in its unactuated position LP1, the flange 266 is aligned with the actuating flanges 230 of the randomizer gear 222. Additionally, when the lever 260 is in its unactuated position LP1, the lock member 272 is engaged with the arm assembly 300 and locks the arm assembly 300 in a position that supports the carriage in its unactuated position P1, as is described in further detail below in connection with FIGS. 10-12.

Still referring to FIGS. 5 and 9, but now in combination with FIG. 8 as well, when a triggering of the trigger member 202 causes a complete actuation of the trigger assembly 200, one of the actuating flanges 230 engages the flange 266 of the lever 260 and rotates the lever 260 about axis A3 in direction D4, to its actuated position LP2. As mentioned, in the depicted embodiment, any triggering that causes the randomizer gear 222 to rotate enough in direction D2 so that the actuating flanges 230 displaces the lever 260 (via flange 266) is considered a complete actuation. If, instead, a triggering simply advances the actuating flanges 230 towards the lever 260, this may be considered a partial actuation.

In the depicted embodiment, the triggering immediately after a triggering that causes the engagement end 242 to traverse one of the longest tapered sections 227(1) causes a complete actuation because this encourages random complete actuations. Notably, the randomizer gear 222 may rotate the clutch 240 into engagement with some part of the longest tapered sections 227(1) from any number of previous stops 225. For example, the randomizer gear 222 may rotate the clutch from one of the longest tapered sections 227(1) to the other in one triggering, two triggerings, three triggerings, etc. based on the strength of the triggering and/or external factors. Then, it may take one or more triggerings to cause the randomizer gear to fully advance over the longest tapered section 227(1) (i.e., for the randomizer gear 22 to rotate its maximum arc distance M1. Consequently, any number of triggerings may occur between complete actuations.

Figure 11:
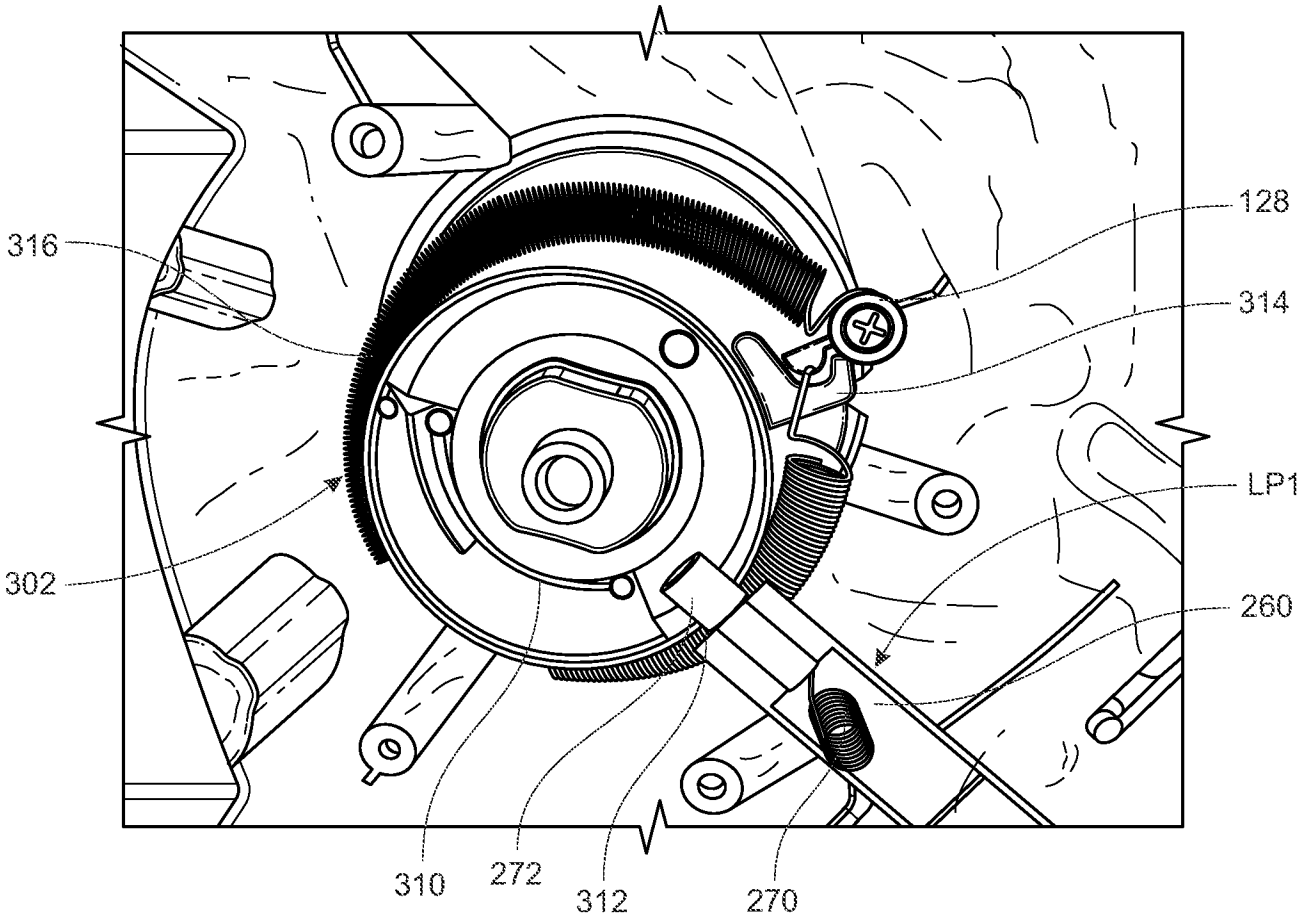
FIG. 11 illustrates a bottom perspective view of the portion of the arm assembly from FIG. 10, the arm assembly being in a locked position.
Figure 12:
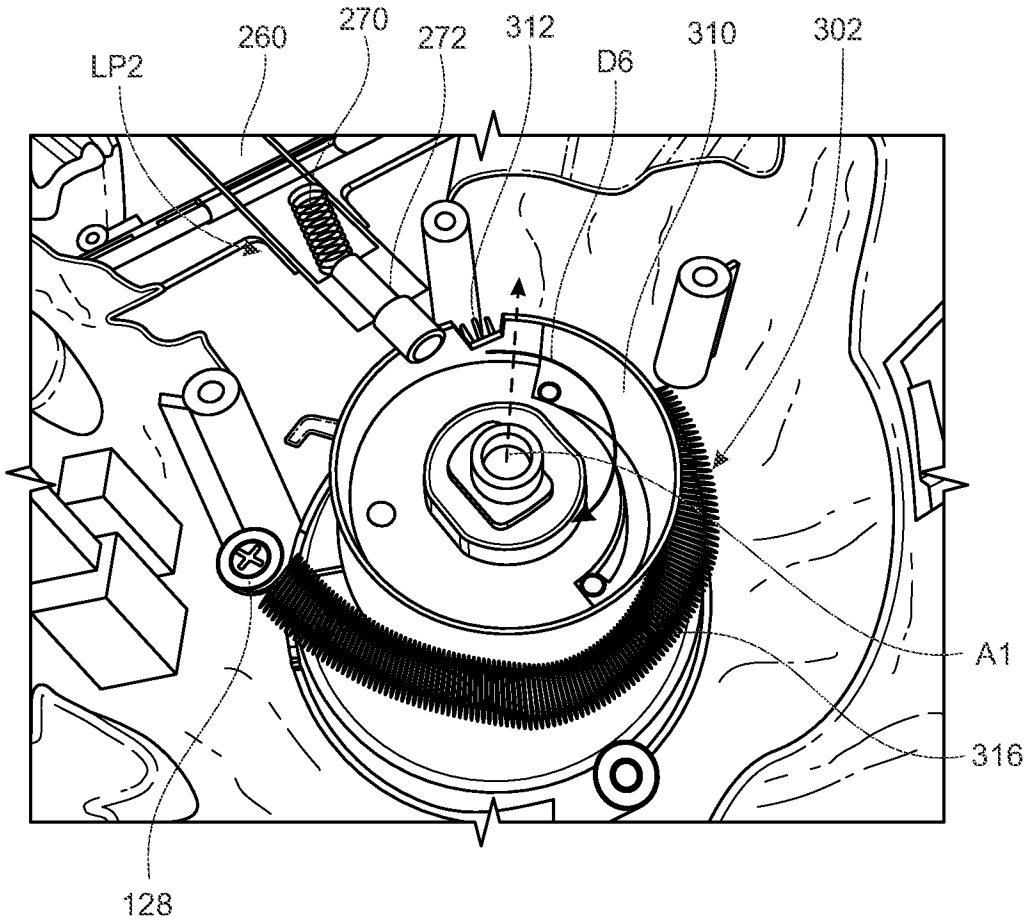
FIG. 12 illustrates a bottom perspective view of the portion of the arm assembly from FIG. 10, the arm assembly being in in an unlocked position.

Still referring to FIGS. 5 and 9, but now with reference to FIGS. 10-12, when the lever 260 is in the actuated position LP2 (and regardless of how the lever 260 is actuated to this position), the lock member 272 is no longer engaged with the rotatable hub 302 of the arm assembly 300 and the arm assembly 300 is free to move the carriage to its actuated position P2. That is, moving the lever 260 to its actuated position LP2 unlocks or releases the arm assembly 300. More specifically, and as can be seen in FIGS. 10-12, moving the lever 260 to its actuated position LP2 moves the lock member 272 out of a corresponding notch 312 included in the base portion 310 of the rotatable hub 302 (when the lever 260 is in its unactuated position LP1, the lock member 272 engages the notch 312 to prevent the rotatable hub 320 from rotating, as shown in FIG. 11). Once the lock member 272 is removed from the notch 312, a biasing member 316 causes the rotatable hub to quickly rotate about the vertical axis A1 in direction D6, as shown in FIG. 12 (axis A1 is also shown in FIG. 2). Notably, the biasing member 316 is wrapped around the base portion 310 of the hub 302, with its first end coupled to a post 128 included in the central housing 110 (see FIG. 1) and its second end affixed to the base portion 310 via the hook 314, in order to cause the quick rotation in direction D6.

Still referring to FIGS. 10-12, in the particular embodiment shown in the Figures, the lever 260 is biased towards its unactuated position LP1 by biasing member 270 (which may act against an unshown support included in the central housing 110 or the trigger assembly extension 130 (see FIG. 1)). Thus, a quick actuation of the lever arm 260 may only move the lock member 272 out of the notch 312 for a short period of time before urging the lock member 272 back towards the bottom portion 310 of the central hub 302. The rotational force created by biasing member 316 may rotate the central hub 302 quickly enough to prevent the lock member 272 from reengaging the notch 312 (which would prevent rotation of the arm assembly 300 subsequent to a complete actuation). However, the force of the biasing member 270 urging the lock member 272 upwards may allow the mechanism 100 to be reset by simply rotating the arm assembly 300 back to a position that supports the carriage in its unactuated position P1. When the carriage 350 is moved back to position P1, the notch 312 also moves back into alignment with the lock member 272 and the lock member 272 automatically engages the notch 302 (due to the biasing from biasing member 270) to lock the arm assembly 300 in place until a subsequent complete actuation of the trigger assembly 200.

Figure 13:
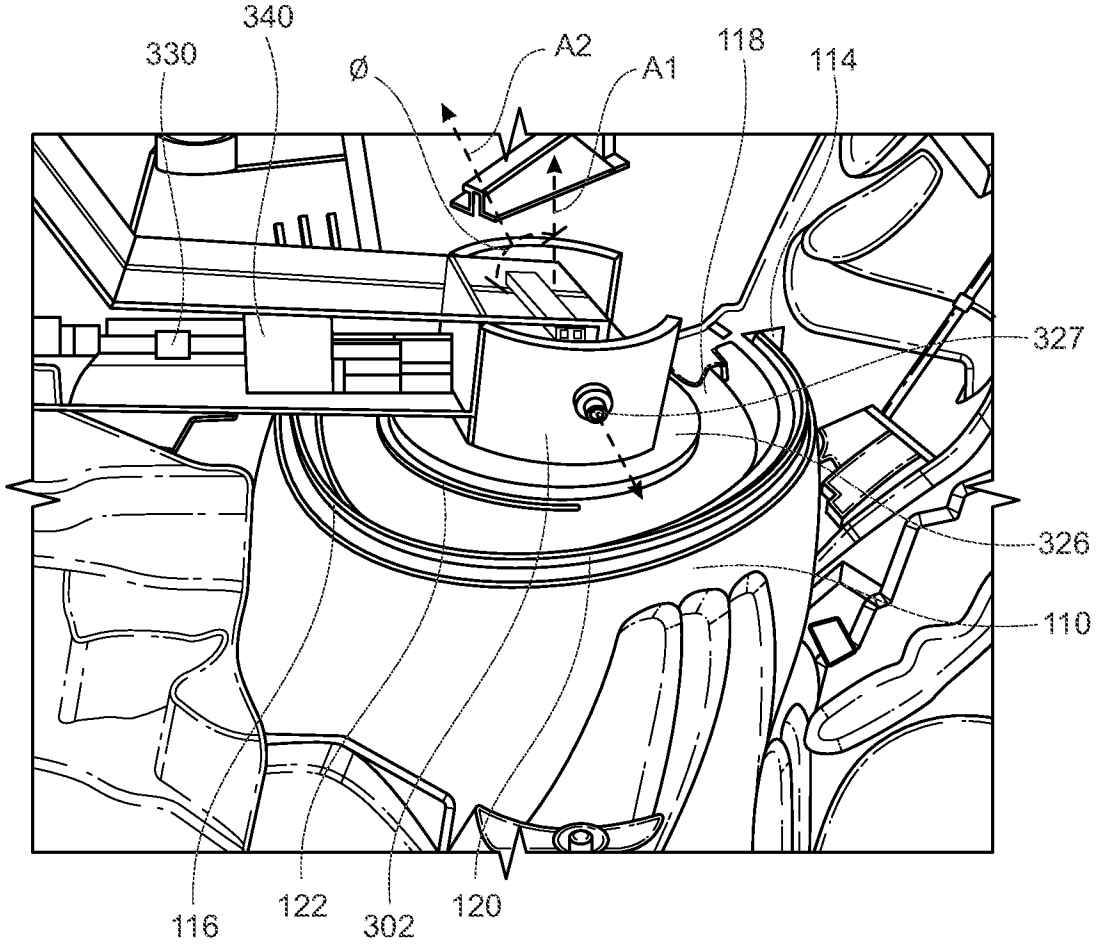
FIG. 13 illustrates a close-up perspective view of inset B from FIG. 1 that shows a portion of the arm assembly that extends through a housing of the toy vehicle track set.

Now turning to FIG. 13, which illustrates a close-up perspective view of inset B from FIG. 1, when the arm assembly 300 is released (i.e., when the lock member 272 disengages from the notch 312), the arm assembly 300 rotates in a counter-clockwise direction (at least when viewed from the perspective views of FIGS. 1 and 2) to move the carriage 350 along the carriage pathway CP (see FIGS. 1 and 2). More specifically, the rotatable hub 302 rotates within the central housing 110, about a vertical axis A1. The arm 330 has one degree of freedom with respect to the rotatable hub 302 (about axis A2, which is orthogonal to axis A1) and, thus, rotation of the rotatable hub 302 causes the arm 330 (and, thus, the carriage 350) to rotate about the vertical axis A1 with the rotatable hub 320.

Notably, the top section 326 of the hub 302 protrudes through a hole 122 included on the top surface 118 of the central housing 110. Consequently, the axis A2 at which the arm 330 is rotatably coupled to the rotatable hub 302 is disposed above the top surface 118 of the housing and the roller 340 can sit atop of a rail 120 that extends circumferentially around the top surface 118 of the central housing 110. This relationship allows undulations of the rail 120 to control the angular displacement of the arm 330 with respect to the top surface 118 and/or the vertical axis A1 as the arm 330 rotates (with the central hub 302) about the vertical axis A1. This angular displacement is illustrated by the angle θ, which extends between the arm 330 and the vertical axis A1, in FIG. 13.

Still referring to FIG. 13, in the depicted embodiment, the rail 120 slopes downwards from a first side 114 to a second side 116. The first side 114 faces the first end 14 of the track 12 and the second side 116 faces the second end 16 of the track 12 (which also slopes downwards from its first end 14 to its second end 16). Consequently, the rail 120 may be configured to angularly displace the arm 330 in a manner that substantially maps to the track 12. That is, the angle θ of the arm 330 with respect to the vertical axis A1 may decrease as the arm 330 moves counter-clockwise around the vertical axis A1 (i.e., from the second end 16 to the first end 14 of the track). However, notably, the rail 120 does not perfectly map to the slope of the track 12 and, in fact, need not even include a constant slope. Instead, the rail 120 may include undulations that allow the arm 330 to move the carriage 350 along the carriage pathway CP that, in essence, swoops or dives into the track path 20 provided by the track 12 in a specific convergence zone CZ, as is described above in connection with FIGS. 1 and 2. More specifically, the rail 120 may initially slope upwards from the second side 116, undulate downwards midway between the second side 116 and the first side 114, and then continue to slope upwards as it approaches the first side 114 in order to ensure the arm 330 moves the carriage 350 through the convergence zone CZ.

Figure 14:
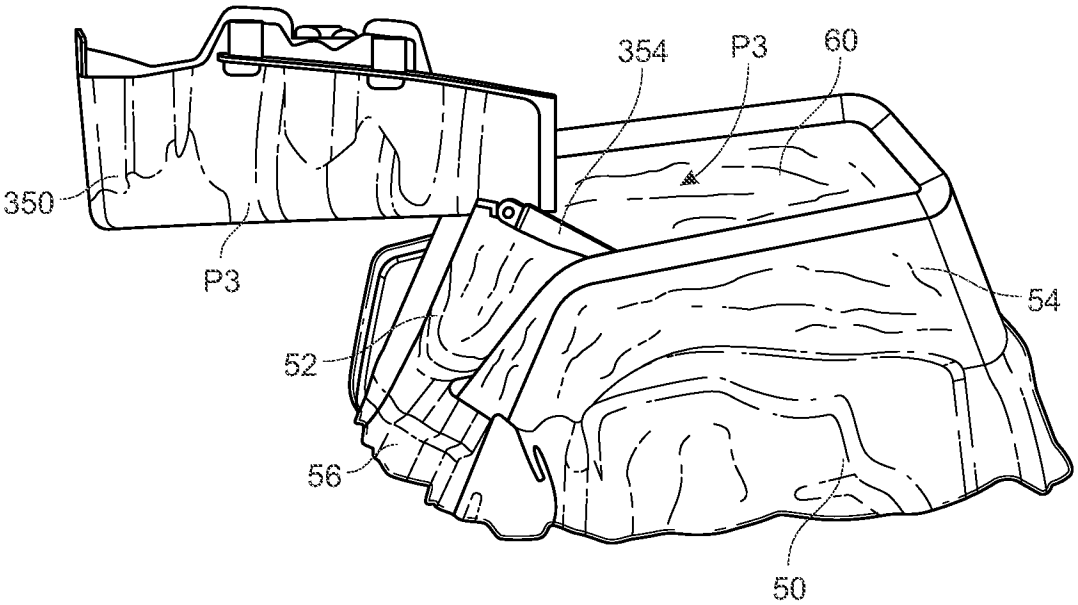
FIG. 14 illustrates a side perspective view of a carriage included in the mechanism of FIG. 3 while in communication with a compartment from the toy vehicle track set of FIG. 1.

Now referring to FIG. 14, once the arm assembly 300 rotates the carriage 350 through its carriage pathway CP, the arm assembly 300 may move the carriage into communication with the compartment 50 (which may be laterally exterior of the first end 14 of the track 12 and the trigger assembly 200, as is described above in connection with FIGS. 1 and 2). The compartment 50 may include a side wall 54 and a bottom 56 that collectively define a receptacle 60 with an open front 52. The receptacle 60 may be sized to receive one or more toy vehicles and may be configured to, in essence, catch toy vehicles that exit the carrier 350 when the carrier 350 reaches its actuated position P2.

For example, in some embodiments, the carrier 350 may swoop into the convergence zone CZ, capture a vehicle and carry the vehicle to the second off-path position P2 to remove the toy vehicle from the track 12. However, upon reaching the second off-path position P2, the arm assembly 300 may abruptly stop and the momentum of the toy vehicle may cause the toy vehicle to travel out of the carrier 350 (i.e., down the lip 354) and into the receptacle. Notably, since the front lip 354 is biased to a downwardly extending position P3, the lip 354 may serve as a ramp between the carrier 350 and the compartment 50. This entire motion may resemble a bird of prey capturing its prey and depositing the prey in its nest.

Although the disclosed inventions are illustrated and described herein as embodied in one or more specific examples, it is nevertheless not intended to be limited to the details shown, since various modifications and structural changes may be made therein without departing from the scope of the inventions and within the scope and range of equivalents of the claims.

For example, in some alternative embodiments, the track 12 and the carriage pathway CP may be concentric about a common axis, where the rail 120 guides the carriage 350 from a starting position P1 that is a certain distance above a second end 16 of the track 12, through a dip that takes the carriage 350 into the convergence zone CZ with the track path 20, and rises back up to a second position P2 that is at another distance above the first end 14 of the track 12. As another example, in some embodiments, the randomizer subassembly 240 may be incorporated into the arm assembly 300 instead of the trigger assembly 200. As still another example, in other embodiments, the mechanism 100 may automatically reset. Additionally or alternatively, the central housing 100 may be disposed in a central location and the rail 120 may include or define any features that cause the mechanism 100 to move the carrier 350 through a convergence zone while moving between two off-path positions. In fact, in some embodiments, the housing 110 need not include a rail and the central hub may vertically move the arm assembly 300 with respect to the track 12.

Moreover, it is to be understood that terms such as "left," "right," "top," "bottom," "front," "rear," "side," "height," "length," "width," "upper," "lower," "interior," "exterior," "inner," "outer" and the like as may be used herein, merely describe points or portions of reference and do not limit the present invention to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment of the invention.

Finally, various features from one of the embodiments may be incorporated into another of the embodiments. Accordingly, it is appropriate that the appended claims be construed broadly and in a manner consistent with the scope of the disclosure as set forth in the following claims.

What is claimed is:

1. A track set for a toy vehicle, comprising:

a track portion defining a track path between a first end of the track portion and a second end of the track portion; and an actuatable mechanism that attempts to capture a toy vehicle as the toy vehicle moves along the track path, between the first end and the second end, in response to select triggerings generated by the toy vehicle traversing the track path, wherein the actuatable mechanism comprises a carriage that traverses a carriage pathway to attempt to capture the toy vehicle as the toy vehicle moves along the track path and the carriage removes the toy vehicle from the track portion when the actuatable mechanism captures the toy vehicle.

2. The track set according to claim 1, wherein the track portion is part of a closed-loop track, such that the toy vehicle can return to the first end of the track portion when the actuatable mechanism does not remove the toy vehicle from the track portion.

3. The track set according to claim 1, wherein the track portion is a curved track portion, wherein the first end of the curved track portion is further above a support surface on which the track set is supported than the second end, such that the track path is descending.

4. The track set according to claim 1, wherein the actuatable mechanism further comprises:

a trigger assembly, wherein each time the toy vehicle traverses the first end of the track portion, the toy vehicle causes a triggering of the trigger assembly and each triggering causes a partial actuation or a complete actuation of the actuatable mechanism; and wherein the carriage traverses the carriage pathway to attempt to capture the toy vehicle in response to the complete actuation of the actuatable mechanism.

5. The track set according to claim 1, wherein the carriage comprises:

a rotatable lip that is biased to a downwardly extending position in which the rotatable lip creates a pathway for the toy vehicle to leave the track portion and enter the carriage.

6. The track set according to claim 4, wherein the actuatable mechanism further comprises:

an arm assembly that moves the carriage along the carriage pathway in response to the complete actuation of the actuatable mechanism.

7. The track set according to claim 1, wherein the carriage pathway begins a distance above the track path, converges on the track path so that the carriage can capture the toy vehicle as the toy vehicle moves along the track path, and terminates laterally exterior of the track path.

8. The track set of claim 7, further comprising:

a compartment disposed laterally exterior of the track path, wherein the carriage pathway terminates at the compartment so that the carriage deposits the toy vehicle in the compartment subsequent to removing the toy vehicle from the track portion.

9. The track set according to claim 4, wherein the toy vehicle travels down the track path, unimpeded and uncaptured, when the toy vehicle causes the partial actuation of the actuatable mechanism.

10. The track set according to claim 4, wherein the trigger assembly further comprises:

a trigger member that is triggered each time the toy vehicle traverses the first end of the track portion;

a randomizer component that causes the partial actuation or the complete actuation of the actuatable mechanism in response to the triggering of the trigger member; and a lever, wherein during the complete actuation, the lever releases the carriage so that the carriage can move along the carriage pathway.

11. An accessory for a toy vehicle track set, comprising:

a trigger assembly that is disposed at a first end of a track portion, wherein each time a toy vehicle traverses the first end of the track portion, the toy vehicle causes a partial actuation or a complete actuation of the trigger assembly; and a carriage that traverses a carriage pathway in response to a complete actuation of the trigger assembly, the carriage pathway beginning a distance above a track path provided by the track portion, converging on the track path so that the carriage can capture the toy vehicle as the toy vehicle moves along the track path, and terminating laterally exterior the track path so that subsequent toy vehicles may traverse the track path unimpeded.

12. The accessory according to claim 11, wherein the distance above the track path is greater than a height of the toy vehicle so that the toy vehicle can continue along the track portion unimpeded after the partial actuation of the trigger assembly.

13. The accessory according to claim 11, wherein the track portion is curved and the accessory comprises:

a central hub that is adjacent, but offset from, a center of curvature of the track portion, the central hub being rotatable about a vertical axis.

14. The accessory according to claim 13, further comprising:

an arm that extends from a proximal end to a distal end, the proximal end being coupled to the central hub and the distal end being fixedly coupled to the carriage.

15. The accessory according to claim 14, wherein the proximal end of the arm is rotatably coupled to the central hub about an axis that is orthogonal to the vertical axis and the accessory further comprises:

a housing within which the central hub rotates, the housing including a top surface that defines a circumferential rail with undulations on which the arm rides, wherein the undulations of the rail control an angular displacement of the arm with respect to the top surface as the arm rotates, with the central hub, about the vertical axis.

16. The accessory according to claim 15, wherein the arm includes a roller that rides along the circumferential rail as the arm rotates, with the central hub, about the vertical axis.

17. A toy vehicle track set comprising:

a track portion defining a track path between a first end of the track portion and a second end of the track portion; and a carriage that is initially disposed in a rest position that is off path from the track path and that is selectively movable, along a carriage pathway, to an actuated position that is also off path from the track path, wherein:

the carriage pathway converges on the track path so that the carriage can capture the toy vehicle, as the toy vehicle moves along the track path, when the carriage is selectively moved; and the toy vehicle can travel, unimpeded, along the track path when the carriage is in the rest position or the actuated position.

18. The toy vehicle track set according to claim 17, wherein the carriage is vertically off-path from the track path when the carriage is in the rest position.

19. The toy vehicle track set according to claim 17, wherein the carriage is laterally off-path from the track path when the carriage is in the actuated position.

20. The toy vehicle track set according to claim 17, further comprising:

a rotatable arm with a raised section, wherein:

when the carriage is in the rest position, the rotatable arm supports the carriage a distance above the track path that allows the toy vehicle to travel along the track path unimpeded; and when the carriage is in the actuated position, the rotatable arm supports the carriage in a position that is laterally offset from the track portion, with the raised section extending over the track portion at the distance above the track portion.

* * * * *